United States Patent [19]

Li et al.

[11] Patent Number: 4,802,268

[45] **Date of Patent: * Feb. 7, 1989**

[54] APPARATUS FOR TEXTURIZING YARN

[75] Inventors: Hsin L. Li, Parsippany; Hendrikus J. Oswald, Morristown; Alfred L. Liland, Wharton, all of N.J.

[73] Assignee: Allied-Signal Inc., Morris Township, Morris County, N.J.

[ * ] Notice: The portion of the term of this patent subsequent to Feb. 21, 2005 has been disclaimed.

[21] Appl. No.: 443,086

[22] Filed: Nov. 19, 1982

Related U.S. Application Data

[60] Continuation of Ser. No. 851,919, Nov. 16, 1977, abandoned, which is a division of Ser. No. 675,353, Apr. 9, 1976, Pat. No. 4,074,405, which is a continuation of Ser. No. 527,464, Nov. 26, 1974, abandoned.

[51] Int. Cl.[4] ..... D02G 1/12; D02G 1/16

[52] U.S. Cl. ..... 28/254; 28/256

[58] Field of Search ..... 28/254, 255, 256, 257

[56] References Cited

U.S. PATENT DOCUMENTS

| | | | |
|---|---|---|---|
| 2,807,862 | 10/1957 | Griset, Jr. | 28/254 |
| 3,036,357 | 5/1962 | Cook et al. | 28/256 |
| 3,438,101 | 4/1969 | LeNoir et al. | 28/256 |
| 3,810,285 | 5/1974 | Ferrier et al. | 28/254 |
| 3,816,887 | 6/1974 | Smith et al. | 28/256 |
| 3,859,696 | 1/1975 | Guenther | 28/254 |
| 3,887,971 | 6/1975 | Guenther | 28/254 |
| 3,923,587 | 12/1975 | Porte | 28/254 X |
| 4,019,228 | 4/1977 | Ozawa et al. | 28/257 X |
| 4,074,405 | 2/1978 | Li et al. | 28/257 |

FOREIGN PATENT DOCUMENTS

| | | | |
|---|---|---|---|
| 47-12222 | 4/1972 | Japan | 28/254 |
| 47-17736 | 5/1972 | Japan | 28/257 |
| 49-555 | 1/1974 | Japan . | |

*Primary Examiner*—Robert R. Mackey

*Attorney, Agent, or Firm*—Richard A. Anderson

[57] ABSTRACT

A tow of continuous filaments is fed by aspiration into a stream of compressible fluid. The stream containing the filaments is directed into contact with a barrier disposed within a chamber at a force sufficient to initiate crimping of the filaments. A major portion of the compressible fluid is separated from the filaments and expelled from the chamber. The filaments are transported through the chamber by continuous movement of a surface therein at sufficient velocity to cause overfeeding of the filaments, whereby the filaments are forced against a mass of the tow and emerge from the chamber in crimped form.

13 Claims, 6 Drawing Sheets

FIG. 7
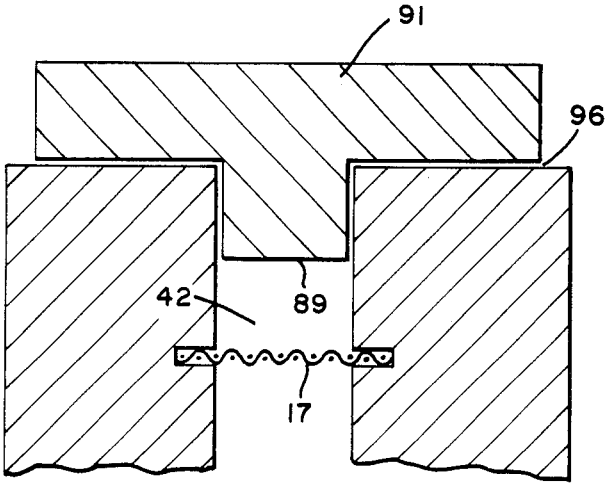
FIG. 8
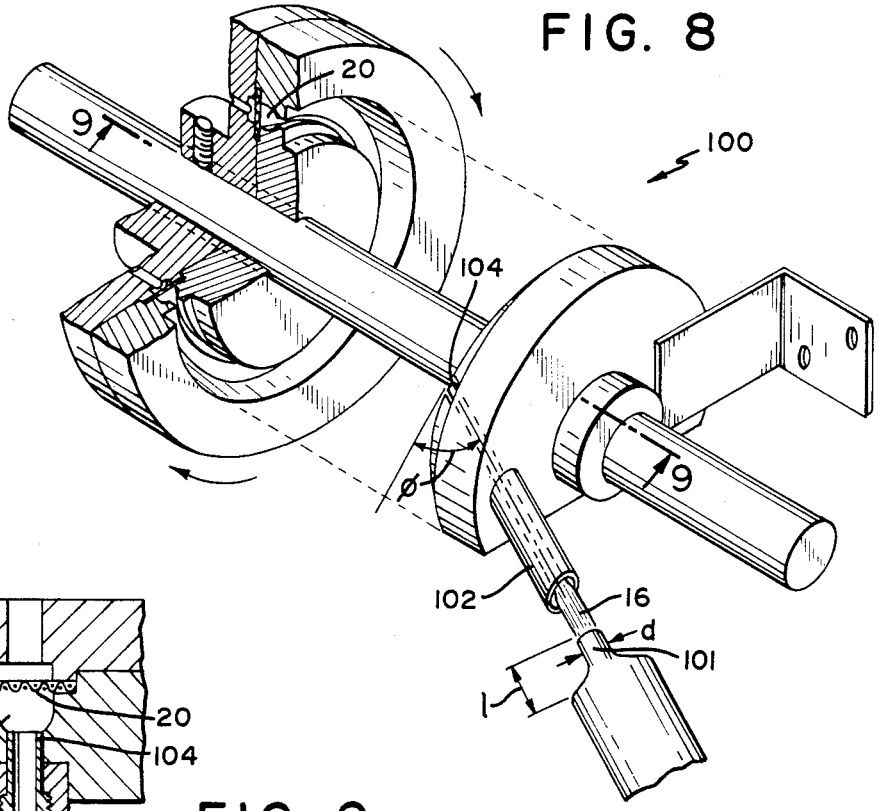
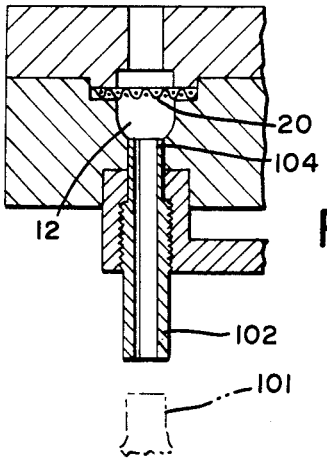
FIG. 9

APPARATUS FOR TEXTURIZING YARN

This application is a continuation of application Ser. No. 851,919, filed Nov. 16, 1977, abandoned, which is a division of Ser. No. 675,353, filed Apr. 9, 1976, now U.S. Pat. No. 4,074,405, which is a continuation of Ser. No. 527,464, filed Nov. 26, 1974, now abandoned.

BACKGROUND OF THE INVENTION

1. Field of the Invention

This invention relates to method and apparatus for preparing crimped fibrous structures and more particularly to means, crimping textile fibrous materials such as synthetic filaments, yarn, tow for staple fibers and the like.

2. Description of the Prior Art

In the apparatus conventionally used to crimp textile strands to increase their bulkiness, a tow of continuous filaments is forced against a mass of tow within a chamber, and emerges in crimped form from the chamber when the pressure on the mass exceeds a certain limit. The number of crimps produced by such apparatus per inch of the filaments as well as the shrinkage, or crimp contraction level produced in the filaments is too low for economical processing of the filaments into high quality knitting yarns, fabrics, high stretch yarns and the like. Moreover, pressure variances on the mass can clog the chamber or alter the residence time of filaments therewith, thereby damaging the filaments and reducing their tensile strengths and/or dyeing uniformity. It has been proposed to regulate the residence time of filaments in the chamber by providing the latter with a continously moving surface. Such apparatus improves uniformity of crimp and reduces streaks in fabrics produced from the filaments, but does not increase appreciably the number of crimps per inch and/or the shrinkage level of the filaments.

SUMMARY OF THE INVENTION

The present invention provides a method and apparatus whereby continuous filaments are crimped economically in a highly efficient and reliable manner. A tow of the filaments is fed by aspiration into a stream of compressible fluid. The combined compressible fluid and filaments are directed into contact with barrier means disposed within a chamber, the force of contact being sufficient to initiate crimping of the filaments. Upon contact with the barrier means, the major portion of the compressible fluid is separated from the filaments and expelled from the chamber. The filaments are transported through the chamber by continuous movement of a surface therein at sufficient velocity to cause overfeeding of the filaments into the chamber. Due to such overfeeding, the filaments are forced against a mass of the tow within a zone of compaction in the chamber and emerge from the chamber in crimped form. The chamber has an inlet opening for receiving the filaments, outlet opening for withdrawing the filaments and fluid escape means for separating the compressible fluid from the filaments and expelling it from the chamber. A carrier means associated with the chamber and adapted for movement with respect thereto forms the continuously moving surface.

It has been found that directing the filaments into contact with the barrier means to initiate crimping before propulsion into the zone of compaction increases the number of incipient crimps as well as the memory thereof within the filaments during initial crimping and presents them in form and condition especially suited for the final crimping stage. The flexibility of the filaments increases and their bending rigidity is reduced, with the result that the crimps are produced in a highly efficient manner. Due to the increased flexibility created in the filaments during initial crimping, the pressure and temperature required in the chamber during final crimping are surprisingly low. The compressible fluid is rapidly expelled through the fluid escape means as soon as initial crimping is completed. Hence, final crimping is accomplished by a pressure and temperature which are considerably lower than that ordinarily expected for material having such a high crimp level. Crimping levels are unusually high, i.e. in excess of 40 crimps per inch and typically as high as 60 crimps per inch or more, shrinkage level is greatly improved, i.e. in excess of 50 percent and uniformity and consistency of crimp are easily controlled. Thus, the texturized filaments of this invention permit production of high-bulk and stretch knitting yarns at higher speeds and lower costs than those incurred by conventional operations wherein the filaments are crimped in a single stage by contact with the mass of tow solely.

BRIEF DESCRIPTION OF THE DRAWINGS

The invention will be more fully understood and further advantages will become apparent when reference is made to the following detailed description and the accompanying drawings in which:

FIG. 7 is a section taken along the line 7—7 of FIG. 6;

FIG. 8 is a perspective view illustrating still another form of apparatus for carrying out the method of this invention, the cover and chamber of the apparatus having a disengaged position, and the chamber being partially broken away to show the construction thereof; and FIG. 9 is a section taken along the line 9—9 of FIG. 8, the cover and chamber of the apparatus having an engaged position.

DESCRIPTION OF THE PREFERRED EMBODIMENTS

The crimping apparatus of this invention comprises a chamber having inlet and outlet and fluid escape openings. Such chamber may be fabricated in a number of diverse sizes and configurations. For illustrative purposes, the invention is described in connection with a chamber having an arcuate configuration. It will be readily appreciated, however, that chambers having linear as well as curvilinear configurations fall within the scope of the present invention.

Figure 1:
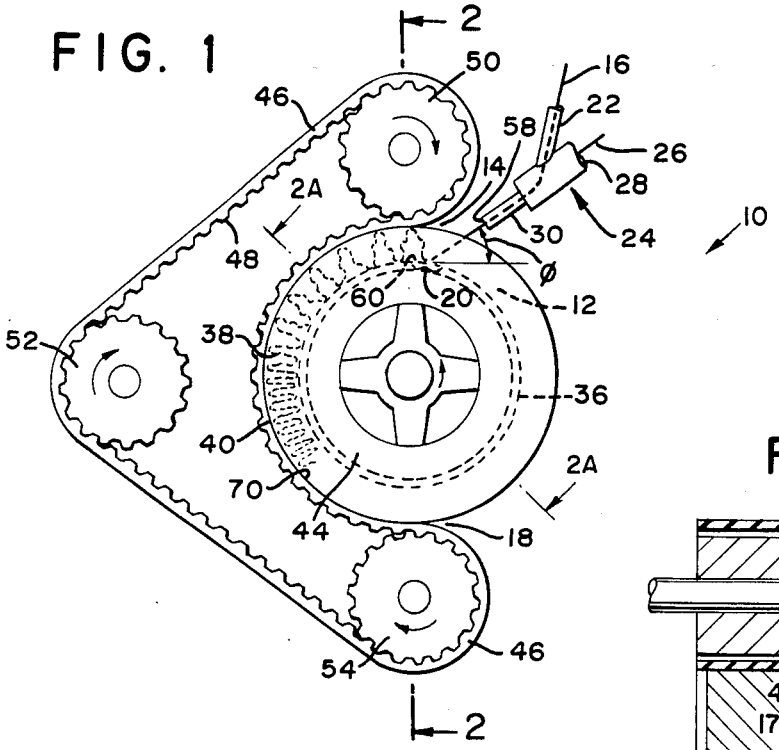
FIG. 1 is a plan view of one form of apparatus for crimping continuous filaments.
Figure 2:
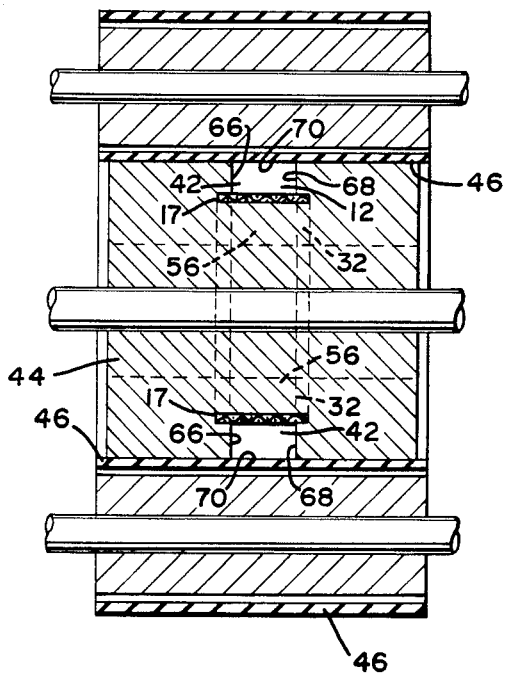
FIG. 2 is a cross-section taken along the line 2—2 of FIG. 1.

Referring to FIGS. 1 and 2 of the drawings, the crimping apparatus, shown generally at 10, has a chamber 12 including an inlet opening 14 for receiving the filaments 16 to be crimped and an outlet opening 18 for withdrawal of the filaments therefrom after crimping. A barrier means 20 which represents a portion of a wire screen 17 as shown in FIG. 1 and described hereinafter, is disposed within the chamber 12 adjacent inlet opening 14. Yarn in the form of a tow of continuous polyester filaments 16 enters yarn inlet 22 of fluid directing means, shown generally at 24. Steam 26 or some other compressible fluid such as air, nitrogen, carbon dioxide and the like enters fluid inlet 28 (shown with a portion broken away) and forces filaments 16 through tube 30 of fluid directing means 24 into contact with barrier means 20, the contact having sufficient force to initiate crimping of the filaments 16. Upon contact with barrier means 20, the major portion of the compressible fluid passes through fluid escape means 32 and is thereby separated from the filaments 16 and expelled from the chamber 12. In order to prevent removal of crimp or deformation initiated in the filaments 16 during separation of the compressible fluid therefrom, it is necessary to prevent the filaments from eing subjected to tension or drag during the period of their residence in chamber 12. The initially crimped filaments 16 are therefore transported through the chamber 12 by carrier means, which comprises a combination of surfaces 36 formed by screen 17 and a surfce 70 formed by a conveyor belt 46, such surfaces 36, 70 being adapted for movement relative to the chamber 12 at a velocity sufficient to cause overfeeding of the filaments thereinto. Due to such overfeeding, the filaments 16 are forced against a mass 38 of the tow within a zone of compaction 40 in the chamber 12 and emerge through outlet openings 18 of the chamber 12 in final crimped form.

Chamber 12 is defined by peripheral recess 42 (shown in FIG. 2) in drum 44 and an endless-notched conveyor belt 46 having notches 48. Rotating notched wheels 50, 52 and 54 drive conveyor belt 46 and serve to guide the belt over the periphery of drum 44. The latter is driven by frictional contact with the belt 46 so that the periphery of drum 44 rotates at substantially the same velocity as belt 46. Wheels 50, 52 and 54 are driven by a motor (not shown), operating to rotate the wheels at the same surface velocity.

Figure 1A:
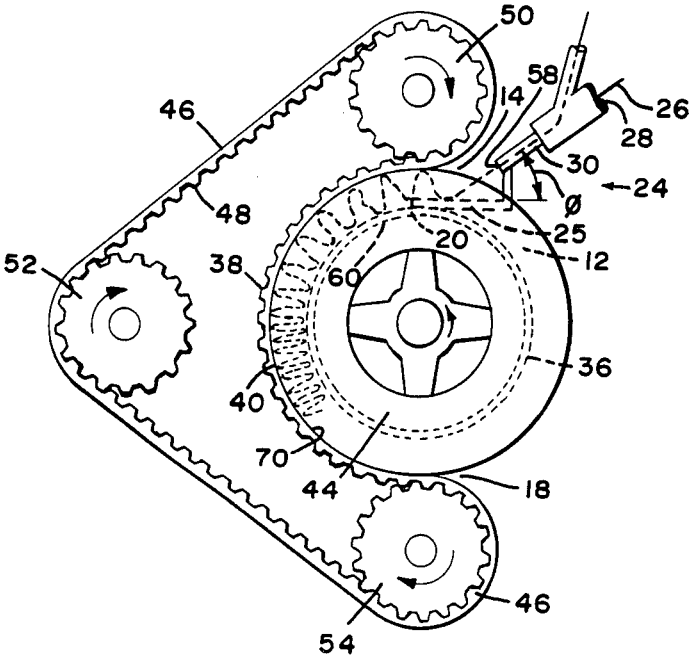
FIG. 1A is a plan view of an alternate form of apparatus for crimping continuous filaments.

The barrier means 20 comprises a portion of the screen 17 adapted to intercept the compressible fluid stream from fluid directing means 24. In the apparatus shown in FIG. 1 of the drawings, the portion of screen 17 which represents barrier means 20 changes continuously as the periphery of drum 44 rotates. Alternatively, as shown in FIG. 1a, the barrier means can comprise a porous or non-porous plate 25 fixedly mounted on the fluid directing means 24 and projecting to a point of interception with the stream inside chamber 12 and adjacent to the inlet means 14 thereof.

Fluid directing means 24 is positioned relative to drum 44 so that the end ;58 of tube 30 is in relatively close proximity to barrier means 20. The distance between end 58 and barrier means 20 as well as the cross-sectional area of the end 58 can vary depending on the velocity and temperature of the filaments and of the compressible fluid stream, the denier of the filaments, the angle at which the stream intersects the barrier means 20, the coefficient of friction of the impacting surface of barrier means 20 and the cross-sectional area of chamber 12. For relatively high speed yarn production, the cross-sectional area of end 58 should be somewhat greater than the cross-sectional area of chamber 12, as on the order of at least about 5 to 1500 percent, and preferably about 200–400 percent greater. Generally, upon impact with the barrier means 20, compressible fluid 26 has a velocity of about 300 to 1400 feet per second and a temperature of about 110° to 450° C. and a total pressure of about 0.1 to 500 psig.; and filaments 16 have a velocity of about 200 to 12,000 feet per minute, a temperature of about 100° to 250° C., and a denier of about 1 to 25 denier per filament, and a yarn denier of about 40 to 3000. The coefficient of friction of the impacting surface is about 0.05 to 0.9, the angle of impact, $\phi$, is about 15° to 75°, the distance between end 58 and point of impact of fluid 26 on surface 60 is about 0.01 to 0.5 inch, the cross sectional area of end 58 is about 0.0004 to 0.20 square inch and the cross-sectional area of chamber 12 is about 0.00015 to 1.00 square inch. Preferably, compressible fluid 26 contacts the impacting surface of barrier means 20 at a velocity of about 600 to 1400 feet per second, a total pressure of about 1 to 300 psig. and a temperature of 150° to 330° C., causing filaments having a denier of about 2 to 15 per filament and a yarn denier of about 45–1000 to contact the impacting surface at a velocity of about 3000 to 12,000 feet per minute and temperature of about 150° to 220° C. The coefficient of friction of the impacting surface is preferably about 0.2 to 0.4, the angle of impact, $\phi$, is preferably about 30° to 60°, the distance between end 58 and point of impact of fluid 26 on surface 60 is preferably about 0.02 inch to 0.06 inch, the cross-sectional area of end 58 is about 0.001 to 0.03 square inch and the cross-sectional area of chamber 12 is about 0.00075 to 0.015 square inch.

Figure 2A:
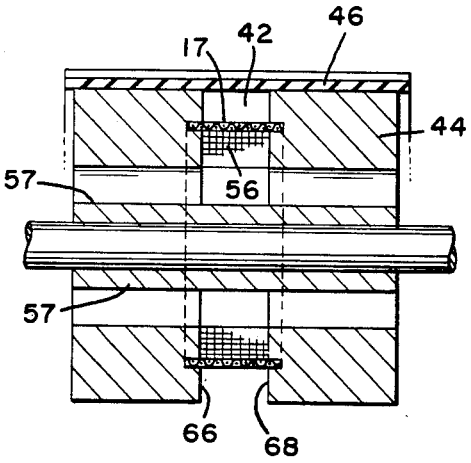
FIG. 2A is a cross-section taken along the line *2a—2a* of FIG. 1.

Fluid escape means 32 is located with respect to barrier means 20 so that a major portion of compressible fluid 26 contacting barrier means 20 is separated from filaments 16 and expelled from chamber 12. As shown in FIG. 2A, the fluid escape means 32 comprises screen 17, together with exhaust chamber 56 and the discharge ports 57 leading to a point exterior of drum 44. The fluid escape means can also comprise a plurality of apertures provided in belt 46, the number and diameters of the apertures being sufficient to separate from filaments 16 and expel from chamber 12 a major portion of fluid stream 26, as in the order of about 60 to 98 percent, and preferably about 70 to 95 percent thereof.

Referring again to FIGS. 1 and 2, filaments 16 entering compaction zone 40 impinge against previously advanced filaments (mass of tow 38) which have not been withdrawn due to the greater feed rate of filaments 16 to zone 40 in comparison to the rate at which the filaments are removed from the zone. As a result of this overfeed, further crimp is imparted to the filaments 16. The crimped filaments move in recess 42 for about one-half a rotation of drum 44 to outlet opening 18 where the crimp is set and the filaments are taken up on conventional bobbins using conventional winders and the like. In this embodiment, the carrier means for transporting filaments 16 through chamber 12 is a surface including walls 66, 68 and screen 17 of recess 42 and side 70 of belt 46. The carrier means 34 can alternatively be comprised of side 70 of belt 46 or screen 17 solely. Carrier velocity varies inversely with the surface area thereof and the crimp frequency desired. Generally, the velocity of the carrier means 34 shown in FIGS. 1 and 2 is about 1-10 percent of the velocity of filaments 16. By varying the velocity of the carrier means, the resident time of filaments 16 in compaction zone 40 is controlled to produce uniformity of crimp and degree of set in the filaments 16 over a wide range of crimp levels The apparatus 10 which has been disclosed herein can be modified in numerous ways without departing from the scope of the invention. As previously noted, the configuration of chamber 12 can be linear or curvilinear. Barrier means 20 can be porous or non-porous, and can comprise a stationary, non-continuous or movable, continuous impacting surface 60. Anvil 74, shown in FIG. 3, can be disposed in chamber 12 opposite impacting surface 60 of barrier means 20 to decrease the cross-sectional area of chamber 12 in the vicinity of barrier means 20. Use of the anvil 74 provides for secondary impact of filaments 16 against rebounding impact surface 75, and increases the number of crimps imparted to each inch of the filaments. Each of peripheral recess 42 of drum 44 and conveyor belt 46 can be constructed entirely of fine wire mesh or screen, to provide for escape of the compressible fluid 26 through all sides of chamber 12.

Figure 3:
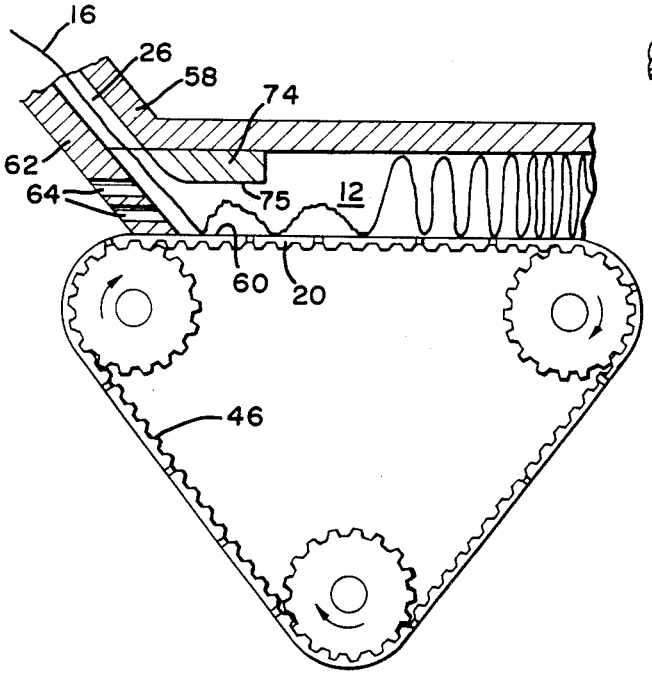
FIG. 3 is a section illustrating another form of apparatus for carrying out the method of this invention.
Figure 3A:
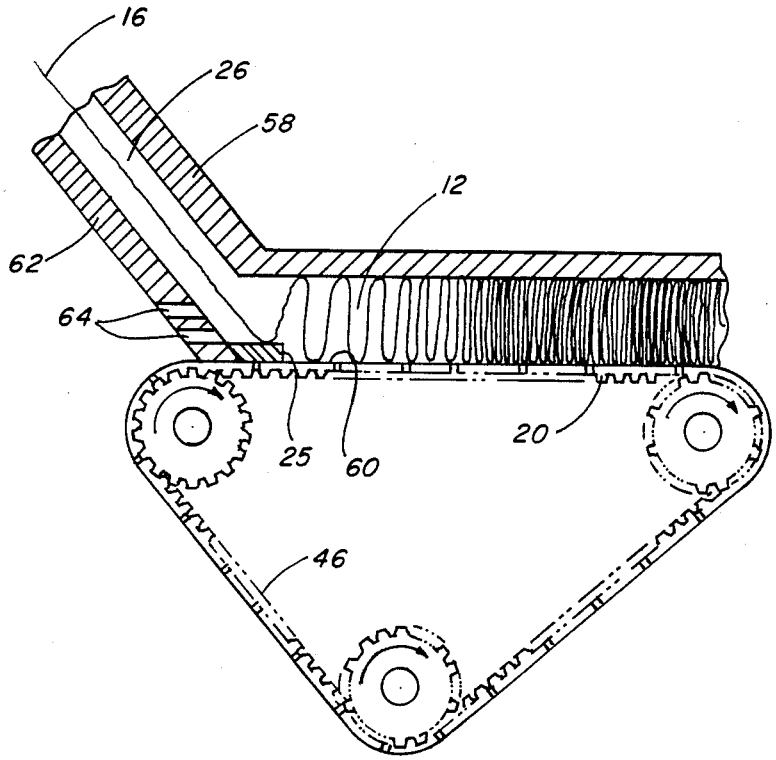
FIG. 3A is a section illustrating the apparatus of this invention using the plate or noncontinuous impacting surface embodiment of this invention.

As shown in FIG. 3A, yarn 16 from energy tube end 58 can first impinge on solid plate or noncontinuous impacting surface 25, rebounding into chamber 12 where it impacts again on the wad of yarn 16.

Figure 6:
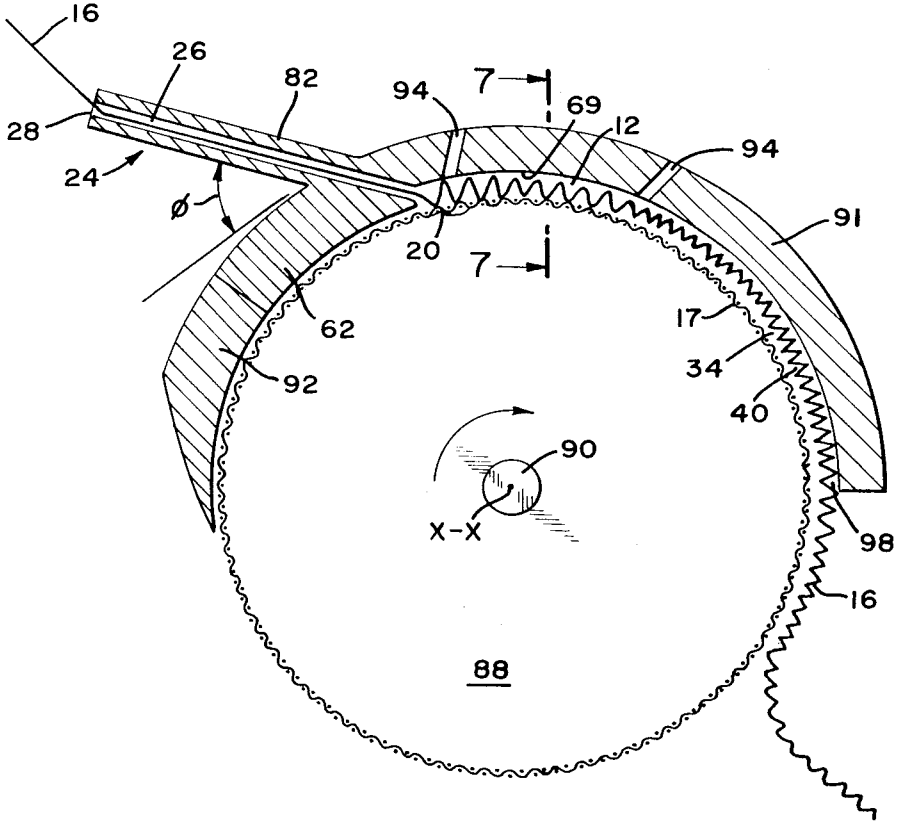
FIG. 6 is a section illustrating another form of apparatus for carrying out the method of this invention.

As shown in FIGS. 5-8, the drum may alternatively be rotatably mounted on a shaft, the chamber 12 being defined by the peripheral recess 42 of the drum and a wall 89 of cover 91. Use of a cover 91 that is stationary relative to the rotating drum facilitates entry of filaments 16 into chamber 12. For t his reason, the embodiment shown in FIGS. 6 and 7 is preferred.

Drum 44 is provided with discharge ports (not shown) extending axially through the drum and connecting with an annular chamber 56 under recess 42. The annular chamber 56 is separated from the recess 42 by wire screen 17, which forms the bottom of recess 42 and, together with chamber 56 and the discharge ports, comprises the fluid escape means 32. Screen 17 has a mesh size ranging from about 50 to 400, and preferably from about 100 to 325. Alternatively, as shown in FIG. 3, the fluid escape means can comprise a shoe 62 (1) extending from end 58 of tube 30 into chamber 12 parallel with and adjacent to the stream of compressible fluid 26 and (2) having a plurality of passageways 64 therein through which fluid separated from filaments 16 escapes from chamber 12.

Figure 4:
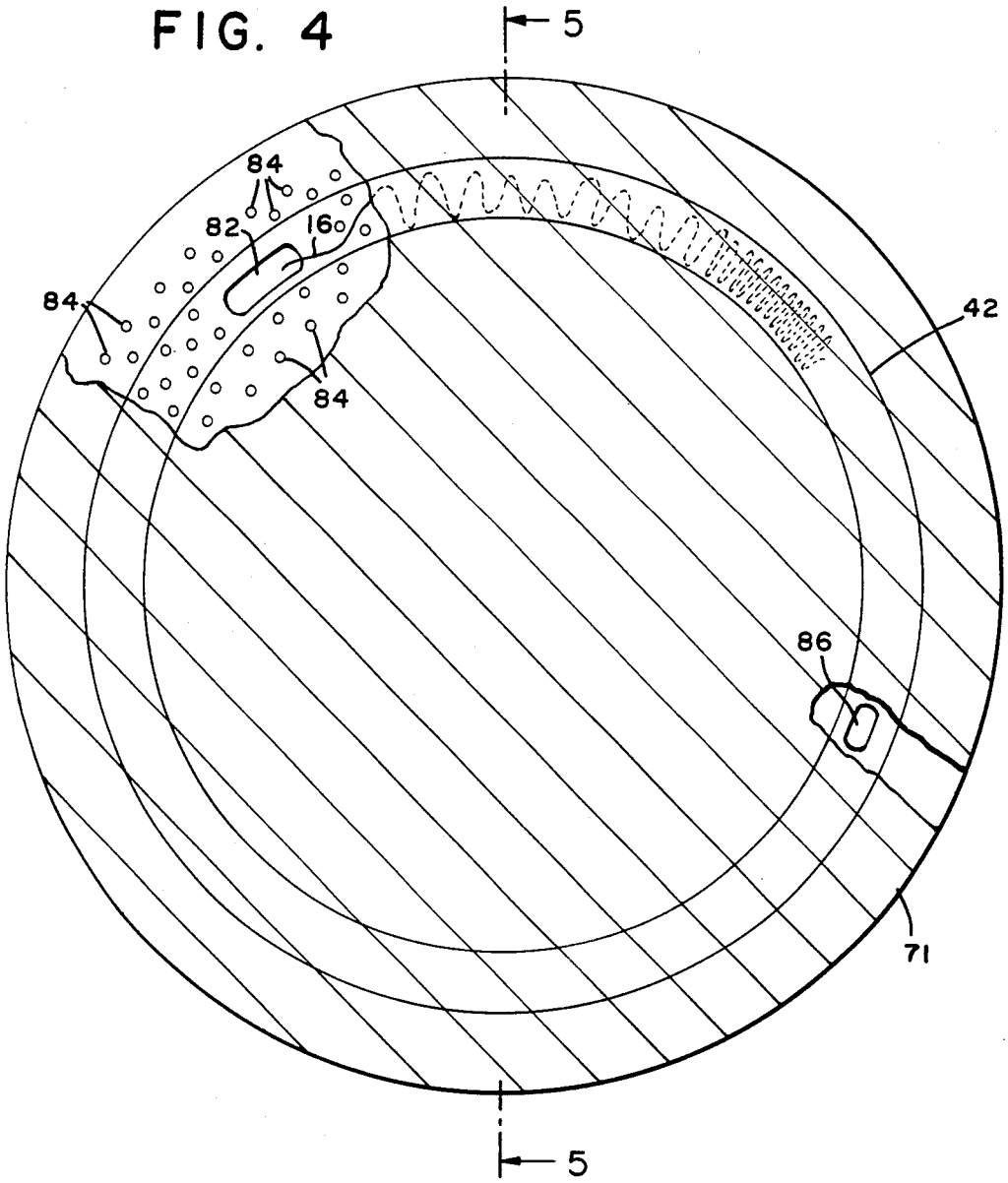
FIG. 4 is a plan view illustrating yet another form of apparatus for carrying out the method of this invention.
Figure 5:
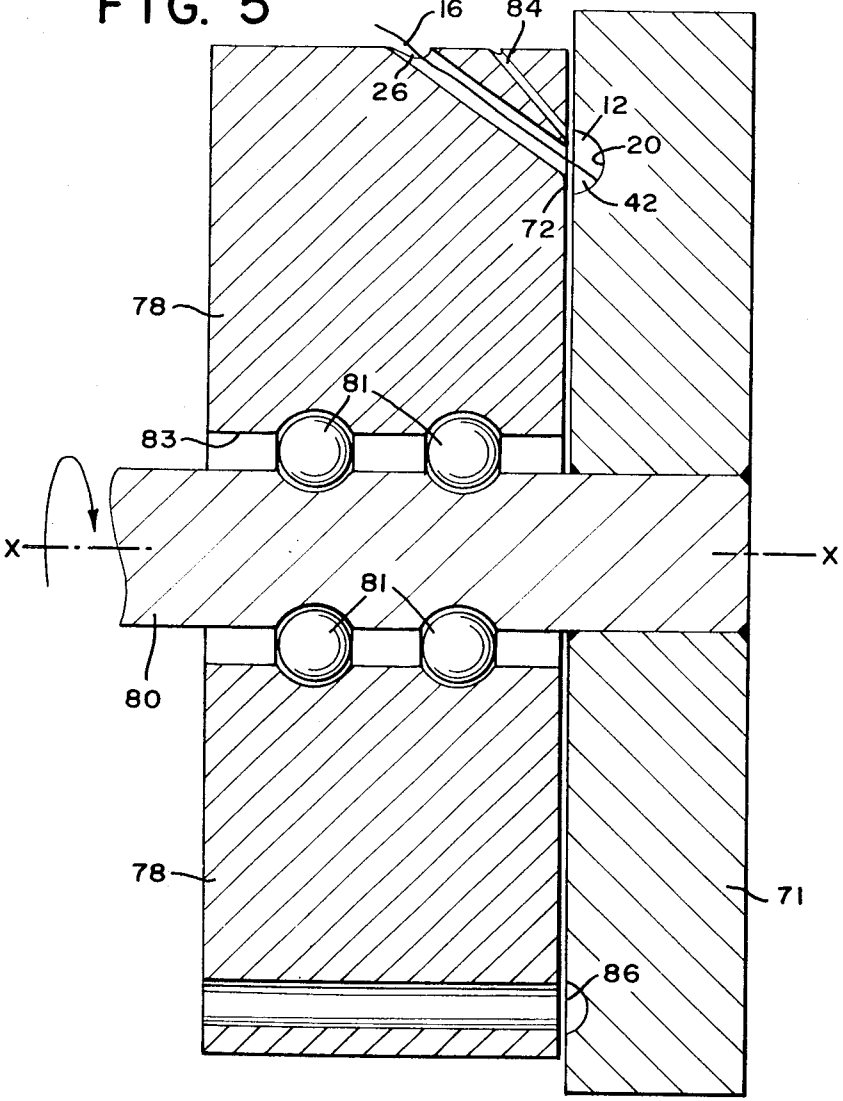
FIG. 5 is a section taken along the line 5—5 of FIG. 4.

As shown in FIGS. 4 and 5, barrier means 20 can be a non-porous, continuous surface forming a wall of recess 42 in disc 71 opposite wall 72 of block 78. The disc 71 is mounted on shaft 80, which rotates on bearings 81 in bore 83 of block 78 about axis x—x. The combined stream of compressible fluid 26 and filaments 16 is directed through energy tube 82 into contact with barrier means 20 disposed within chamber 12, in the manner previously set forth in connection with FIGS. 1 and 2. Compressible fluid 26 is separated from filaments 16 and expelled from chamber 12 through passageways 84 in block 78. Disc 71 rotates about axis x—x, transporting filaments 16 through chamber 12. The filaments 16 emerge from chamber 12 through outlet 86.

Another form of apparatus for carrying out the method of the invention is shown in FIGS. 6 and 7. The barrier means 20 of this embodiment is a porous, continuous surface in the form of a perforated plate or screen 17 forming a wall of recess 42 in drum 88 opposite wall 89 of cover 91. The drum 88 is mounted on shaft 90 for rotation about axis x—x in the manner set forth in connection with FIGS. 4 and 5. The combined stream of compressible fluid 26 and filaments 16 is directed through tube 82 into contact with barrier means 20 disposed in chamber 12, in the manner previously set forth in connection with FIGS. 1 and 2. Rear extension block 92, connected to tube 82 by rivets (not shown), adhesive or the like, prevents filaments 16 or plugs thereof which are inadvertently broken during residence in chamber 12 from reentering the chamber 12. Compressible fluid 26 is separated from the filaments 16 and expelled from chamber 12 through passageways 94 in cover 91 and also through passageways 96 formed between disc 88 and cover 91. Drum 88 rotates about axis x—x, transporting filaments 16 through chamber 12. The filaments 16 emerge in crimped form from chamber 12 through outlet 98. These and other modifications are intended to fall within the scope of the invention as defined by the subjoined claims.

While the method and apparatus of this invention have been described herein primarily in terms of texturizing thermoplastic filaments, especially polyester filaments, it is clear that the method and apparatus of the present invention can also be used to crimp a wide variety of other filaments, such as filaments composed of homopolymers and copolymers of the following materials: c-aminocaproic acid, hexamethylene adipamide, ethylene terephthalate, tetramethylene terephthalate and cyclohexamethylene terephthalate. In addition, the filaments 16 can be composed of polyacrylonitrile, polypropylene, poly-4-aminobutyric acid and cellulose acetate.

The following examples are presented in order to provide a more complete understanding of the invention. The specific techniques, conditions, materials and reported data set forth to illustrate the principles and practice of the invention are exemplary and should not be construed as limiting the scope of the invention.

EXAMPLE 1

A 150 denier, 34 filament polyethylene terephthalate yarn was aspirated through tube 82 of fluid directing means 24 (FIGS. 6-7) at a velocity of about 2250 feet per minute with steam entering fluid inlet 28 at a temperature of about 370° C. and a pressure of about 150 psig. Fluid inlet 28 had an internal diameter of 0.027 inch and a length of 0.5 inch. Tube 82 had an internal diameter of 0.050 inch and a length of 2.5 inch. The rotational speed of drum 88 was about 22.4 revolutions per minute. The yarn was directed by tube 82 into contact with the barrier means 20 within a chamber 12, the angle of contact, $\phi$, being of the order of about 45°. The barrier means was a brass plate having a thickness of 0.014 inch and containing a plurality of apertures. Each of the apertures had a diameter of 0.009 inch. The apertures were separated by a center to center distance of 0.016 inch and were sufficient in number to provide the plate with 25.4 percent open area. Chamber 12 had a width of 0.062 inch and a depth of 0.034 inch. Drum 88 was rotated so that carrier means 34 had a surface velocity of about 33.5 feet per minute. Contact between the yarn-containing stream and the barrier means 20 initiated crimping of the filaments. A carrier means transported the yarn to a zone of compaction 40 within chamber 12. A mass (plug) of yarn formed within the zone 40, causing further crimping of the filaments. The yarn emerged in crimped form from chamber 12 through outlet means 98 and was taken up onto conventional parallel wound packages rotated on conventional winders by means of a pair of rollers (not shown). The speed of the winder was approximately 1260 feet per minute. The textured denier of the yarn was 228.

The yarn obtained in accordance with this example was characterized as having a three-dimensional crimp. Such yarn had a skein shrinkage of 48%. The skein shrinkage test consisted of winding the textured yarn into a skein; hanging the skein under no load in a hot air oven at 145° C. for 5 minutes. The skein was removed from the oven and a 0.0016 gram per denier weight was hung on it. The new skein length was measured ($L_f$). The percent of skein shrinkage was then calculated from the initial skein length ($L_o$) and the final skein length ($L_f$) in accordance with the equation $(L_o-L_f)/L_o$. The yarn contained 50.5 average crimps per inch and was especially suited for production of knitted fabric, as it had high bulk and stretchability.

A series of further runs was conducted using impact angles of 15°, 30°, 60°, and 75°. The procedure employed for each of the runs was in all respects the same as that set forth in Example 1, except that the yarn outlet speed for the runs was varied in order to optimize the number of crimps per inch and skein shrinkage level. The resulting data of the run of Example 1 and the subsequent runs are set forth in the following table:

TABLE

| Run | Yarn Outlet Speed (ft/min) | Impact Angle | Crimps per inch | Skein Shrinkage Level (%) |
|---|---|---|---|---|
| 1 | 1260 | 45° | 50.5 | 48 |
| 2 | 1598 | 15° | 45.6 | 47 |
| 3 | 1406 | 30° | 44.0 | 46 |
| 4 | 1699 | 60° | 47.1 | 45 |
| 5 | 1103 | 75° | 45.1 | 46.3 |

EXAMPLE 2

Polyethylene terephthalate chips having a number average molecular weight of 28,000 was melt spun using a screw type extruder in which the barrel and die temperatures were maintained at 270° C. and 280° C., respectively.

The spinneret used had 34 holes, each hole having a capillary diameter of 0.010 inch and a length of 0.010 inch. An air quenched system was used to solidify the filaments.

The spun yarn was a 255 denier, 34 filament, zero twist, partially oriented yarn having a round cross-section. The yarn was coated with approximately 0.05% by weight of a textile finish agent and drawn using a draw ration of 1.9. The drawing process consisted of passing 10 wraps of the yarn around (1) a pair of heated rolls maintained at a temperature of 75° C., (2) a stationary block heater 6 inches long having a temperature of 180° C. and (3) a pair of draw rolls having a temperature of 175° C. The final draw denier was 140. Drawing speed was 2,000 feet per minute.

The yarn was then texturized using the apparatus shown in FIGS. 8 and 9. Nozzle 101 of the apparatus, shown generally at 100, had a length 1, of 0.5 inch and an internal diameter, d, of 0.027 inches. Superheated steam at 280° C. and 100 psig. was supplied into nozzle 101 through conduit means (not shown). The yarn (filaments) 16 was carried at high velocity by steam exiting nozzle 101 into tube 102 at 568 feet per minute. Energy tube 102 had an inside diameter of 0.047 inch and an outside diameter of 0.375 inch, and was 2.25 inches long. The yarn was heated to a tempertaure of about 196° C. and impinged against barrier means 20 to an impact angle, $\phi$ of 60°. The barrier means 20 was a 200 mesh screen-surfaced disc, 3.8 inches in diameter and spaced 0.0362 inch from the exit orifice 104 of energy tube 102. Chamber 12 had a cross-sectional area of 0.002 square inch. The chamber 12 was rotated at a peripheral speed of 10 feet per minute and carried the crimped yarn away from the stream so that the yarn could be cooled sufficiently within the chamber 12 to set the crimps therein. The yarn was removed from the chamber 12 upon angular displacement of the screen 330° from the energy tube orifice, and was wound at a velocity of 400 feet per minute.

The yarn produced had a denier of 190. Photomicrographs made of 20 filaments selected at random from the texturedyarn showed crimp count of 64 crimps per inch and crimp amplitude of 0.011 inch. There was no fusion among filaments of the yarn. The yarn had a three dimensional, helical configuration.

Skeins were made from the textured yarn. The average skein shrinkage level was determined to be 50 percent. Under identical skein conditions, 168 denier, 34 filament yarn produced using a conventional false twist method had a skein shrinkage level of 50 percent and a crimp level of 50 crimps per inch.

The textured yarn produced in accordance with Example 2 was knitted on a Lawson-Hemphill Fiber Analysis Knitter having a 54 gauge head, 220 needles, a diameter of 3 ½ inches and 36 inches per course. The knitted fabric, when dyed, showed excellent uniformity and was free from streaks. In addition, the fabric had a soft texture, dimensional stability and pleasing appearance.

EXAMPLE 3

Polyethylene terephthalate yarn used in this Example was extruded and processed using the method and apparatus described in Example 1, except that the angle of impact, $\phi$, was 85°.

Yarn crimped in this fashion was entangled, knotted and non-uniform along the yarn axis, and was of lower quality than yarn produced in accordance with the method set forth in Example 1.

In operation, a tow of filaments 16 is fed by aspiration into a stream of compressible fluid 26. Fluid directing means 24 directs the compressible fluid 26 containing filaments 16 into contact with barrier means 20, disposed within chamber 12 to initiate crimping of the filaments 16. Fluid escape means 32 separates the major portion of the compressible fluid 26 from the filaments 16 and expels it from chamber 12. A carrier means transports the filaments 16 through chamber 12 at a velocity sufficient to cause overfeeding of the filaments 16 into the chamber. The filaments 16 are subsequently forced against a mass of the tow within a zone of compaction 40, emerge from the chamber 12 in crimped form, and are wound onto packages.

Having thus described the invention in rather full detail, it will be understood that these details need not be strictly adhered to but that various changes and modifications may suggest themselves to one skilled in the art. It is accordingly intended that all matter contained in the above description and shown in the accom-panying drawings shall be interpreted as illustrative and not in a limiting means.

We claim:

1. Apparatus for crimping a tow of continuous filaments comprising:

(a) a chamber having an inlet opening for receiving the filaments, and an outlet opening for withdrawing the filaments;

(b) a movable perforate yarn-receiving means at least partially disposed in said chamber adjacent said inlet opening;

(c) a stationary, noncontinuous impacting surface disposed in said chamber adjacent said inlet opening;

(d) fluid directing means having an angular disposition relative to said impacting surface for directing a stream of compressible fluid containing said filaments into contact with said impacting surface to initiate crimping thereof, the angle of disposition ranging from about 15° to 75° and being such that impingement of said filaments on said impacting surface occurs within said chamber; said yarn receiving means being adapted to separate the major portion of said fluid from said filaments and to expel it from said chamber and to provide a continuously moving surface associated with said chamber, the velocity of said surface being adjusted to cause overfeeding of said filaments into said chamber, the ratio between the velocity of said filaments and the velocity of said surface and the angular disposition of said fluid directing means being such that said filaments are initially crimped by impact against said impacting surfce and deflected therefrom against a mass of said tow to produce final crimping of the filaments, and emerge from the chamber in crimped form.

2. Apparatus as recited in claim 1, wherein said chamber has a linear configuration.

3. Apparatus as recited in claim 1, wherein said chamber has a curvilinear configuration.

4. Apparatus as recited in claim 1, wherein said yarn receiving means has a coefficient of friction of about 0.05 to 0.9.

5. Apparatus as recited in claim 1, wherein said yarn receiving means is a screen having a mesh size ranging from about 50 to 400.

6. Apparatus as recited in claim 1, wherein said chamber has an anvil disposed opposite said impacting surface so as to decrease the cross-sectional area of said chamber and provide for secondary impact of said filaments in the vicinity of said impacting surface.

7. Apparatus as recited in claim 1, wherein said fluid directing means comprises a tube having an end located in relatively close proximity to said yarn receiving means, the cross-sectional area of said end being at least about 5 to 1500 percent greater than the cross-sectional area of said chamber.

8. Apparatus as recited in claim 1, wherein said yarn receiving means is a plate containing a plurality of apertures, the number of apertures being sufficient to separate from said filaments and expel from said chamber about 6 to 98 percent of said fluid.

9. Apparatus as recited in claim 1, wherein said impacting surface is a nonporous plate.

10. Apparatus as recited in claim 1, wherein said impacting surface is porous.

11. Apparatus for crimping a tow of continuous filaments comprising:

(a) a chamber having an inlet opening for receiving the filaments, and an outlet opening for withdrawing the filaments;

(b) a movable perforate yarn-receiving means having a covered entry at least partially disposed in said chamber adjacent said inlet opening; and (c) a stationary impact surface disposed in said chamber adjacent said inlet opening; (d) fluid directing means having an angular disposition relative to said impact surface for directing a stream of compressible fluid containing said filaments into contact with said impact surface to initiate crimping thereof, the angle of disposition ranging from about 15° to 75° and being such that impingement of said filaments on said impact surface occurs within said chamber; said yarn receiving means being adapted to separate the major portion of said fluid from said filaments and to expel it from said chamber and to provide a continuously moving surface associated with said chamber, the velocity of said surface being adjusted to cause overfeeding of said filaments into said chamber, the ratio between the velocity of said filaments and the velocity of said surface and the angular disposition of said fluid directing means being such that said filaments are initially crimped by impact against said impact surface and deflected therefrom against a mass of said tow to produce final crimping of the filaments, and emerge from the chamber in crimped for.

12. Apparatus as recited in claim 11 wherein said chamber has a linear configuration.

13. Apparatus as recited in claim 11 wherein said chamber has a curvilinear configuration.

* * * * *